United States Patent [19]

Chow

[11] 4,389,014

[45] Jun. 21, 1983

[54] VENT DAMPER WITH EMERGENCY MANUAL OVERRIDE

[75] Inventor: Ho Chow, River Edge, N.J.

[73] Assignee: Melnor Industries, Inc., Moonachie, N.J.

[21] Appl. No.: 254,774

[22] Filed: Apr. 16, 1981

[51] Int. Cl.[3] ..... F23N 3/00; F16K 35/00

[52] U.S. Cl. ..... 236/1 G; 126/285 B; 251/101; 431/20

[58] Field of Search ..... 251/101, 134; 236/1 G; 431/20; 126/285 B

[56] References Cited

U.S. PATENT DOCUMENTS

| | | | |
|---|---|---|---|
| 2,698,140 | 12/1954 | Buehler | 236/1 G UX |
| 2,919,601 | 1/1960 | Cain, Jr. | 251/101 UX |
| 4,017,024 | 4/1977 | Grostick et al. | 236/1 G |
| 4,143,811 | 3/1979 | Sattmann | 110/163 X |

*Primary Examiner*—William E. Wayner

*Attorney, Agent, or Firm*—James & Franklin

[57] ABSTRACT

In the event of a malfunction of the unit, the damper plate may be moved to and locked in the open position, to permit the furnace to operate. With the plate locked, the motor would normally run continuously, even when the furnace was not operating. This is because the closed position of the plate, necessary to turn off the motor, cannot be reached. A slip clutch, located between the motor shaft and the plate, has parts which slip relative to each other when the motor is running but the plate is locked. The contours and biasing of the parts causes one part to move a limited distance, in a direction opposite to normal. The motor is stopped in response to this oppositely directed movement.

A bent portion of the plate positioning shaft is freely received in a recess elongated in and laterally spaced from the motor shaft for self-alignment and to permit the oppositely directed movement necessary to stop the motor.

32 Claims, 23 Drawing Figures

FIG. 18
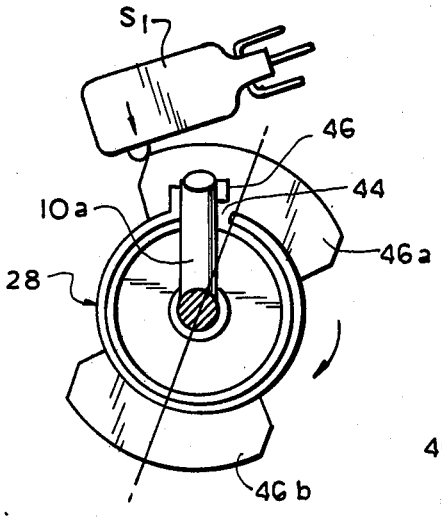
FIG. 19
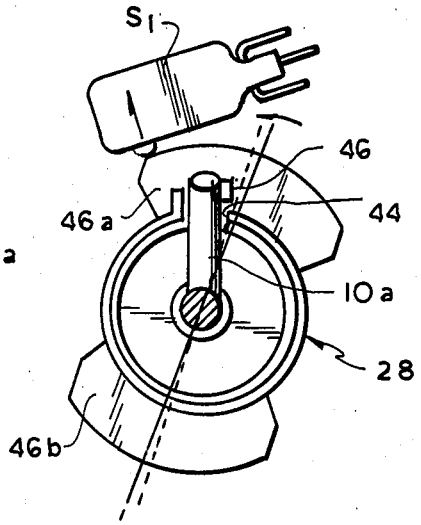
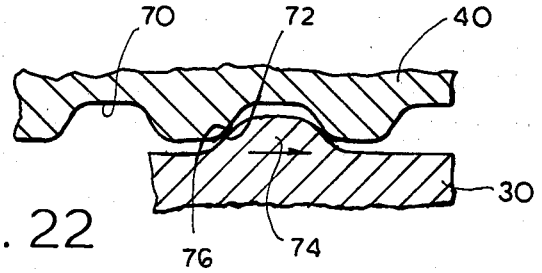
FIG. 22
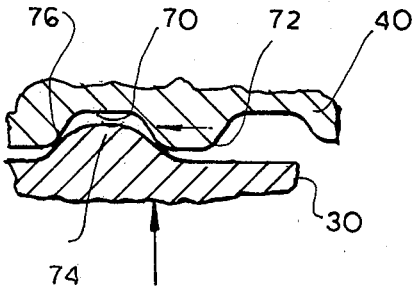
FIG. 20
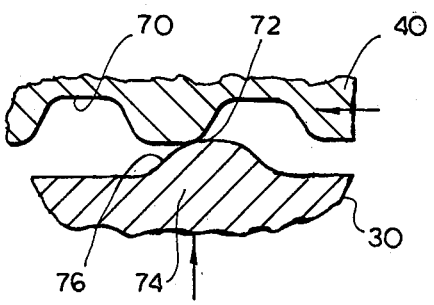
FIG. 21

VENT DAMPER WITH EMERGENCY MANUAL OVERRIDE

The present invention relates to a damper designed for use in conjunction with any type of device which causes fluid to flow through a conduit and requires the opening and closing of the conduit, such as the vent for an oil or gas-fired furnace and, more particularly, to an automatically controlled vent damper unit which includes an emergency manual override designed to permit safe operation of the furnace in the event of a malfunction of the unit.

Residential and commercial furnaces, be they oil or gas fired, are vented to the atmosphere by means of a stack or flue, through which the noxious gas by-products of combustion are normally safely dissipated. During the last decade, because of the rapidly increasing costs of fossil fuels, a great deal of attention has been directed towards increasing the efficiency of conventional furnaces.

It is well known that a substantial portion of the heat generated by a furnace is lost to the atmosphere as it escapes through the stack along with the noxious gases. With the intention of capturing a portion of this normally lost heat, vent dampers were developed to close the flue when the furnace was not in operation. Vent dampers consist of a plate, made of sheet metal or the like, mounted within the flue so as to rotate to open and close same. A means is provided for keeping the plate in the open position when the furnace is operating (and preferably for a short time thereafter to permit the stack to cool to a given degree). At all other times the damper is kept in the closed position. By keeping the damper in the closed position as much as possible, at least some of the heat which normally would be lost to the environment can be retained and, thus, usefully employed.

Safety is a main concern to the designers of vent dampers. A device which failed to operate as intended, that is, the damper plate failed to be positioned in the fully open position when the furnace was operative, could result in the build-up of noxious gases which could be lethal. Thus, the vent dampers had to be designed to fail with the plate in the open position to permit safe operation of the furnace or to prevent the furnace from operating during failure.

In one type of damper, the damper plate was spring-loaded toward its fully open position. The motor was utilized to keep the plate to its closed position, against the spring loading, during times when the stack was to be closed. Thus, if the unit failed, the plate would automatically return to the open position, such that the furnace could operate safely. While this type of device worked satisfactorily from the safety point of view, it required that the motor be continuously energized to keep the damper plate in the closed position. Thus, the motor ran most of the time. This required a relatively large amount of electric power, created a great burden on the motor, and reduced the useful life of the device. Moreover, the noise created by the continuously running motor was undesirable.

In order to overcome this, systems were devised wherein the motor is energized only when the damper position requires changing. Thus, the motor is energized only when the damper plate is moved from the fully open to the fully closed position, or vice versa. The motor is automatically de-energized when the plate attained the desired position. This significantly reduced the time during which the motor was energized, preserving the motor, reducing the amount of power utilized by the device, and reducing the noise generated.

For safety considerations, this type of system is designed so that the furnace can operate only when the plate is in the fully open position. However, in the event of a malfunction of the damper unit, there is no way to keep the plate in the fully open position. Thus, the furnace could not operate and emergency servicing of the damper unit was required or the furnace would not be operable for a prolonged period of time, possibly leading to the inhabitability of the structure which the furnace was designed to heat.

To permit the furnace to operate safely, even if the vent damper unit became inoperative, a manual override could be provided. A lever, accessible from the outside of the flue and connected to the plate to position same, could be incorporated as part of the unit. The plate could then be manually moved to the open position and locked in that position. In this way, the furnace could be made to operate safely until the vent damper unit was repaired.

While the manual override provided for the safe operation of the furnace during malfunction of the damper unit, it created a different problem. After operation of the furnace terminated and the stack cooled sufficiently, the motor was automatically energized to move the plate from the open to the closed position. Normally, the motor was de-energized as the plate reached the closed position. However, if the plate was locked in the open position, it could never reach the closed position to de-energize the motor. Thus, the motor would run indefinitely, using electricity needlessly, creating a great deal of noise, and, perhaps, even resulting in the eventual burning out of the motor.

The above-mentioned vent damper units also have other problems in common. One such problem relates to the alignment of the motor output shaft and the shaft which controls the position of the damper plate. These shafts are designed to be coaxially aligned and are rotatably mounted within the unit by means of spaced sets of conventional bearings. However, if these shafts are not precisely axially aligned, rotation of the shafts causes excess friction and wear at the bearings, substantially reducing the useful life of the device.

A second common problem relates to the overheating of the parts of the unit. The portion of the unit which automatically controls the position of the damper plate is normally situated within an enclosure which is mounted adjacent the flue, at a location in proximity to the plate. Since the flue is heated by gas flowing inside thereof to a very high temperature (approximately 1000° F.), the enclosure which houses the unit tends to become quite hot. This heat may result in the destruction of the control components, particularly when same are composed of plastic or the like.

It is, therefore, a prime object of the present invention to provide a vent damper with an emergency manual override wherein the motor will be automatically de-energized when the plate is locked in the open position and conditions would normally cause the motor to remain energized until the plate reached the closed position.

It is another object of the present invention to provide a vent damper with emergency manual override wherein a slip clutch is provided between the motor output shaft and the plate and means are provided for sensing slipping of the clutch, when the plate is locked and the motor is energized, and for de-energizing the motor in response thereto.

It is another object of the present invention to provide a vent damper with emergency manual override wherein the normally interengaging parts of the clutch are contoured and biased in a manner such that, as the parts slip, the part resiliently connected to the locked plate will move in a direction opposite to its normal direction of movement.

It is another object of the present invention to provide a vent damper with emergency manual override wherein limited movement of the clutch part connected to the locked plate, in the opposite direction, is utilized to terminate energization of the motor.

It is another object of the present invention to provide a vent damper with emergency manual override wherein the plate is connected to the clutch part in a resilient manner to permit movement of the part, in the direction opposite to the normal direction of movement, against the bias of the resilient connection.

It is another object of the present invention to provide a vent damper with manual override wherein means are provided to permit laterial movement between the motor output shaft and the plate positioning shaft, in the event of axial misalignment therebetween.

It is another object of the present invention to provide a vent damper with emergency manual override wherein the control mechanism for the damper plate is provided with heat shielding means such that heat from the stack does not destroy the mechanism.

In accordance with one aspect of the present invention, a vent damper of the type having drive means, a movable damper plate and means for drivingly interconnecting the plate and the drive means is provided. Means are also provided for controlling the drive means in response to the position of the plate. The control means is effective, when the plate is in a given position, to energize the drive means. The energization of the drive means normally results in movement of the plate from the given position. The improvement comprises means for de-energizing the drive means in the event that the plate is prevented from moving from the given position.

The de-energization means comprises slip clutch means, operatively connected between the drive means and the plate. The clutch means is adapted to slip, during energization of the drive means, if movement of the plate from the given position is prevented. Means, responsive to the slipping of the clutch means, are provided for terminating the energization of the drive means.

The clutch means comprises first and second parts. The parts are operably connected for movement with the drive means and the plate, respectively. Each of the parts has engaging means thereon. Means are provided for normally biasing the engaging means to interengage.

The engaging means are effective to interengage the parts in a first relative position, wherein the biasing means cooperates with the engaging means to prevent relative movement between the parts and in a second relative position, wherein the biasing means cooperates with said engaging means to cause relative movement between the parts, from the second relative position to a third relative position.

Because of the contours of the respective engaging means, relative movement from the second relative position to the third relative position is in a direction opposite to the direction of relative movement between the first relative position and the second relative position. The apparatus reacts to this movement in the opposite direction to terminate the energization of the motor.

The relative movement between the parts of the clutch means comprises slipping of the clutch. The slipping responsive means is responsive to the movement of the parts, from the second to the third relative positions, and is effective to terminate energization of the motor when this movement is sensed.

The engaging means on the first part comprises a recess. The engaging means on the second part comprises a protrusion adapted to be at least partially received in the recess. The biasing means urges the parts together such that the protrusion is normally received into the recess and the parts move together in the same direction to drive the plate.

The engaging means on the first part further comprises a protrusion which partially defines the recess. The engaging means on the second part comprises an inclined surface. The inclined surface on the second part forms a portion of the protrusion. At the second relative position, the corner of the protrusion on the first part aligns with the inclined surface on the second part such that the force applied by the biasing means causes the corner of the protrusion to slide down the inclined surface. This causes the parts to move to the third relative position.

Resilient connecting means are provided to bias the parts against movement from the second relative position to the third relative position. This connection preferably comprises a spring which is active to maintain the plate positioning shaft in a given position with respect to the second part.

Energization of the drive means, which is preferably in the form of an electrical motor, causes the first clutch part, which is keyed to the output shaft of the motor, to rotate. A protrusion on the second clutch part is normally biased into a recess on the first part, such that the second part rotates along with the first part. This is the first relative position of the parts. Since the second part is resiliently connected to the plate, rotation of the second part will cause the plate to move.

In the event that the damper plate is locked in the given position, such that movement thereof is prevented, the energization of the motor will cause the first part to move relative to the second part in a first direction, until the second relative position is reached. The corner of the protrusion, which partially defines the recess on the first part, is then in contact with the top of the protrusion of the second part. At this point, similarly inclined surfaces on the respective protrusions align. Because the surfaces are inclined in a direction opposite to the first direction, and the parts are biased toward each other, the second part will now be caused to move in a direction opposite to the first direction, against the bias of the resilient connecting means, to the third relative position. The relative movement of parts is limited by the structure of the resilient connecting means. It is this limited backward movement of the second part which causes the switch which controls the energization of the motor to turn off the motor. In this manner, the motor is de-energized, immediately after energization, if the plate is locked.

The slip clutch means preferably forms a portion of the interconnecting means which connects the motor output shaft and the plate positioning shaft. The resilient connecting means comprises a spring lever mounted to and extending from the interconnecting means which serves to bias the plate positioning shaft into a normal position with respect to the interconnecting means.

The device further comprises locking means for preventing the plate from moving from the given position which, in this instance, is the fully open position. The locking means preferably comprises a lever, extending to the external portion of the flue, which has a locking screw thereon which, when set, prevents the movement of the damper plate.

The damper is designed for use in conjunction with a power source and a temperature sensitive switch means, such as a thermostat, which serves to connect the control means to the source. This occurs when heat is demanded, as indicated by the sensing of a temperature below a given level by the temperature sensitive switch means. The control means, when energized, is in turn effective to connect the drive means to the source to move the plate to the open position, if the plate is not in the open position.

The damper is designed for use with an appliance having a flue in which the plate is situated. The control means further comprises flue temperature sensitive means operably connected to the source, and first and second switches. The first switch is switchable between a first position, wherein the drive means is conditionally connected to the source through the flue temperature sensitive switch means, and the second position, wherein the drive means is conditionally connected to the source through the temperature sensitive switch means. The second switch is switchable between a first position, wherein the appliance is conditionally connected to the source through the temperature sensitive switch means, and the second position, wherein the appliance is disconnected from the source.

The control means further comprises a relay, operably connected in parallel to the appliance, and having normally closed contacts, operably connected between the source and the first position of the first switch. The control means will cause the damper plate to move to the open position when the appliance is energized. The relay prevents the motor from being energized, to move the plate to the closed position, when the appliance is operative. When the heat demand has been satisfied, the appliance de-energized and the stack has cooled to an appropriate temperature, the motor will be energized to move the plate to the closed position.

In the event of a malfunction of the unit, the plate may be locked in the open position, to permit safe operation of the appliance. However, when the heat demand has been satisfied and the stack has cooled sufficiently, normal energization of the motor, to move the plate to the closed position, will be rapidly terminated by the operation of the clutch.

In accordance with a second aspect of the present invention, a vent damper is provided comprising drive means having a rotatable output member, a movable damper plate having a rotatable input member, means for energizing the drive means to rotate the output member and means for drivingly interconnecting the output member and the input member for simultaneous rotation. The interconnecting means comprises means for permitting limited lateral movement between the output member and the input member, as said members rotate.

The lateral permitting means comprises a part extending in a direction substantially parallel to the axis of rotation of the output member, but laterally spaced therefrom. The part has a recess therein. The input member is provided with a section which is bent from the axis of rotation thereof. The bent input member section is freely received in the recess.

The part is substantially cylindrically shaped and co-axially aligned with the output member. The recess is formed in the wall of the part and is elongated in a direction substantially parallel to the axis of rotation of the output member.

Resilient means, active on the bent section of the input member, are provided for positioning the input member relative to the recess. The resilient means is active on the input member in a direction which is tangential to the axis of rotation of the input member.

The resilient means preferably comprises a spring lever extending from the surface of the interconnecting means in a direction substantially parallel to the axis of rotation of the output member. The lever is laterally spaced from the axis of rotation of the output member and positioned alongside the recess.

The energizing means comprises switch means having actuator means. The actuator means is controlled by the position of the part of the interconnecting means which rotates with the plate. The interconnecting means part includes cam means which are moved relative to the actuator means, by the motor, in order to control the actuation of the switch means.

In accordance with a third aspect of the present invention, a vent damper is provided comprising a movable damper plate located within a vent, a support, drive means mounted on the support, output means connected to be driven by the drive means, and means, on said support, for positioning the plate relative to the vent. Means, located on the support, are provided for operably drivingly connecting the output means and the plate positioning means. Means are provided on the support for controlling the drive means. Heat shield means, physically interposed between the support and the vent, are provided to shield the support and the components thereon from the heat of the vent.

The heat shield means comprises a planar member having first and second surfaces facing the support and the vent, respectively. The member is provided with an opening therein through which the plate positioning means extends. The heat shield means may comprise one or more substantially parallelly situated planar members.

To the accomplishment of the above, and to such other objects as may hereinafter appear, the present invention relates to a vent damper with emergency manual override, as described in detail in the following specification and recited in the annexed claims, taken together with the accompanying drawings, wherein like numerals refer to like parts, and in which:

FIG. 18 is a view of the interconnecting means showing the position thereof when the plate is in the fully open position;

FIG. 19 is a view of the interconnecting means showing the position thereof in the motor de-energization position;

FIG. 20 is a cross-sectional view showing the parts of the clutch in the first relative position;

FIG. 21 is a cross-sectional view showing the parts of the clutch in the second relative position; and FIG. 22 is a cross-sectional view showing the parts of the cam in the third relative position.

Figure 1:
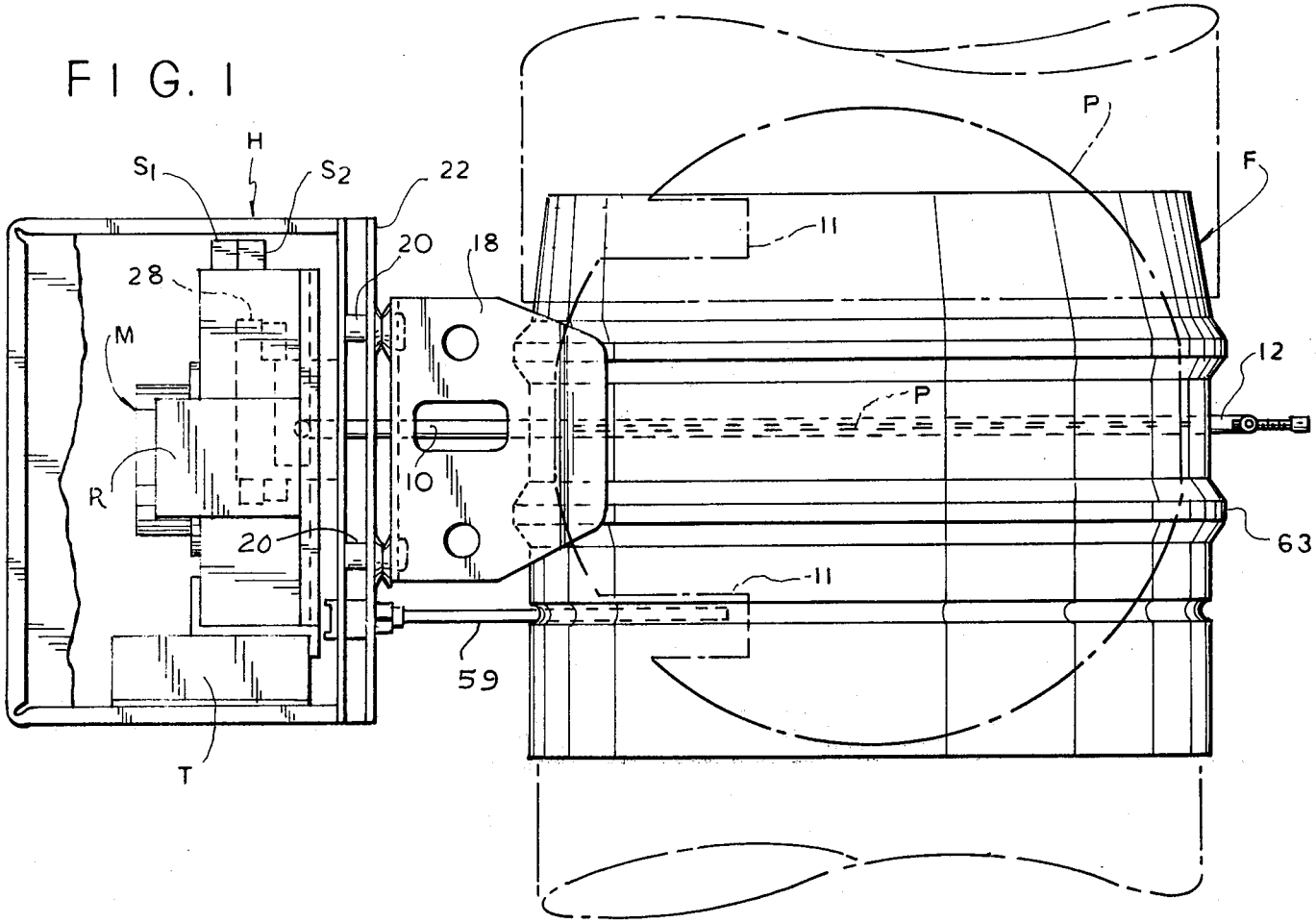
FIG. 1 is a side elevation view of the present invention.
Figure 2:
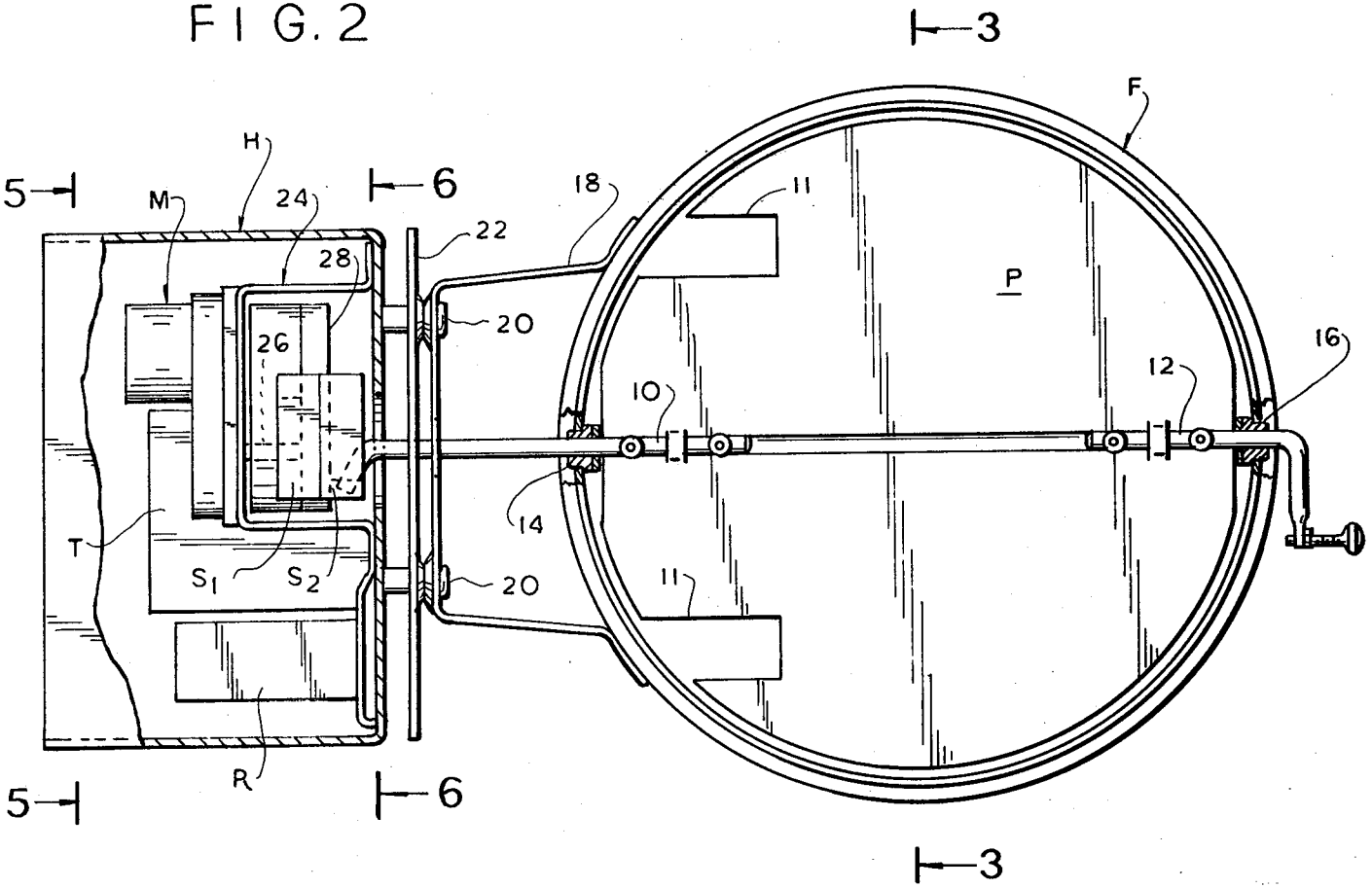
FIG. 2 is a top plan view of the present invention.
Figure 3:
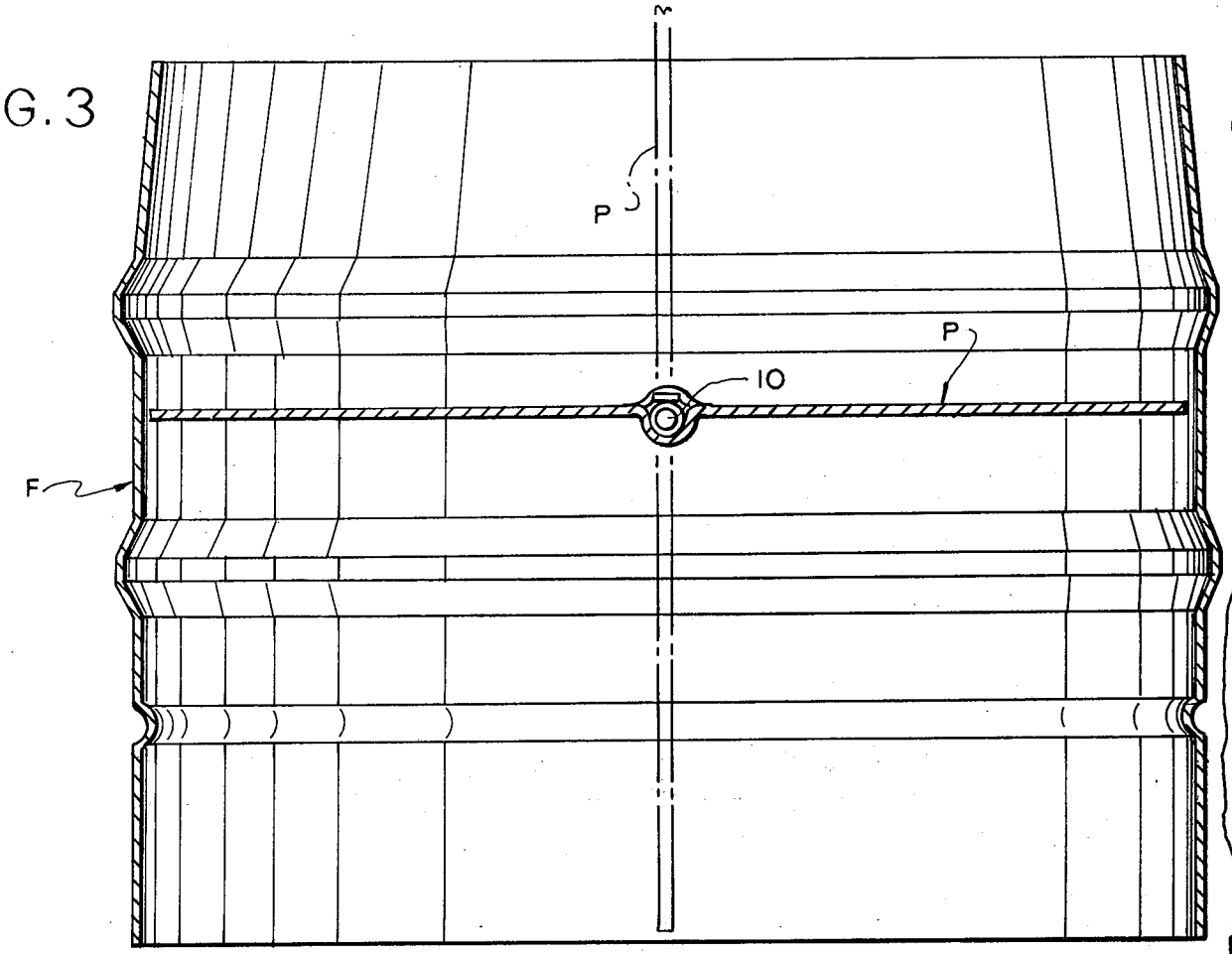
FIG. 3 is a cross-sectional view of the flue, taken along line 3—3 of FIG. 2, showing the plate in the closed position.
Figure 5:
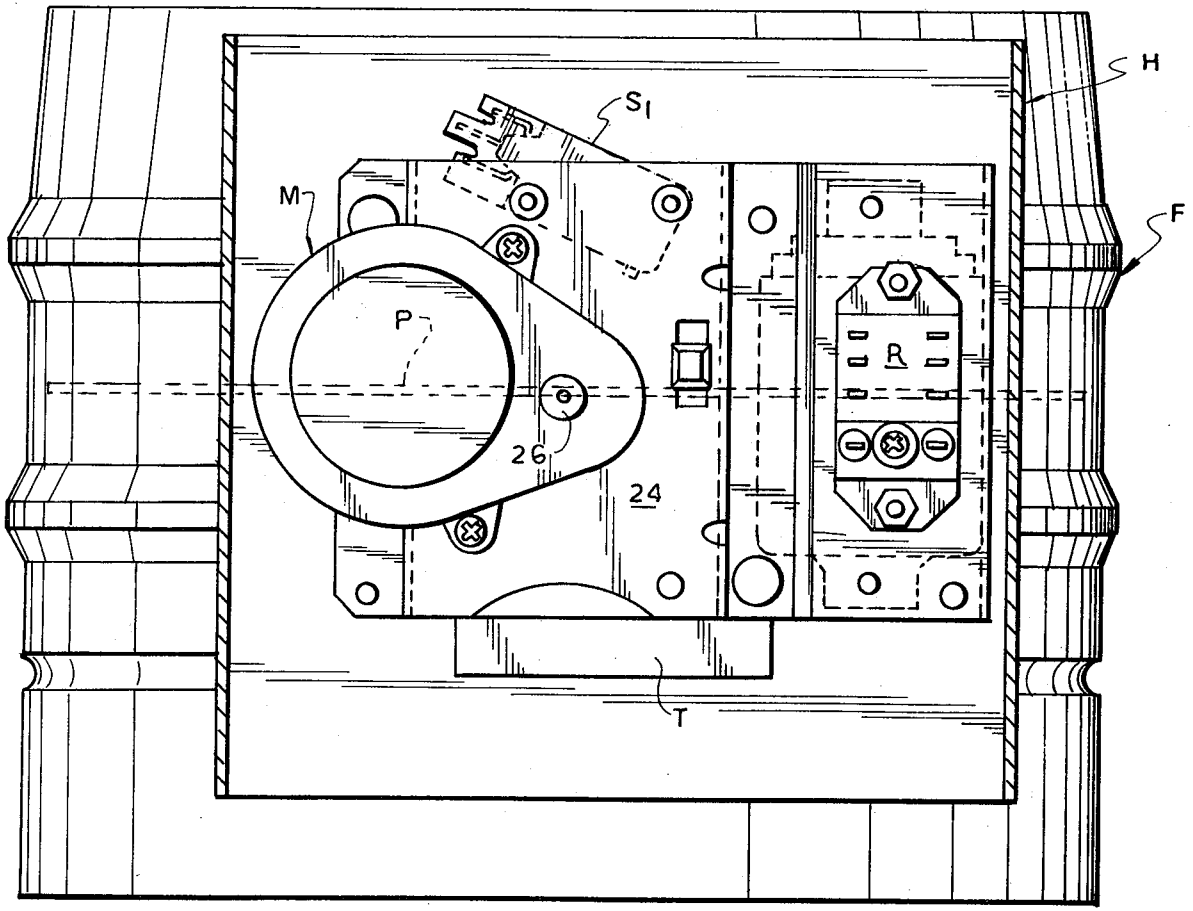
FIG. 5 is a front view of the present invention taken along line 5—5 of FIG. 2.
Figure 6:
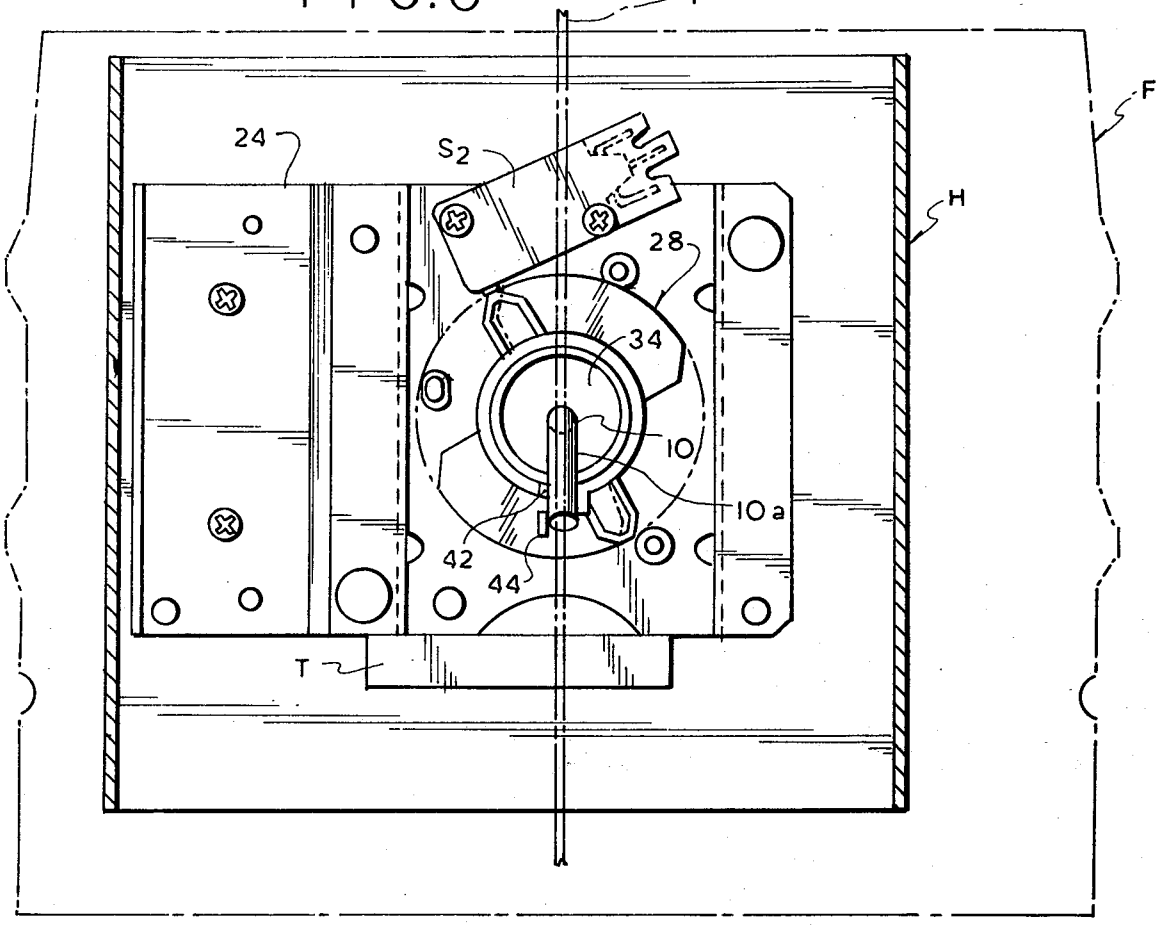
FIG. 6 is a rear view of the present invention taken along line 6—6 of FIG. 2.

As is illustrated in FIGS. 1–7, the vent damper with emergency manual override of the present invention comprises a substantially round plate, generally designated P, preferably composed of sheet metal or the like, which is situated within a section of a flue, generally designated F, which connects a furnace to a stack. The diameter of plate P is only slightly smaller than the inner diameter of flue F, such that when plate P is in the fully closed position, as shown in FIG. 3, gas flow through flue F is substantially prevented. In order to change from the fully open position to the fully closed position, plate P is rotated 90° with respect to flue F. Plate P is provided with recesses 11, such that flue temperature sensitive switch 59, located in flue F, does not prevent the free movement of the plate P.

Plate P is mounted on a pair of spaced central shafts 10, 12, each of which extends from plate P through the wall of flue F, at diametrically opposed points thereon. Bearings 14 and 16 (FIG. 2) are provided within the wall of flue F such that shafts 10 and 12, respectively, and thus plate P, can freely rotate with respect to the wall of the flue.

The control mechanism for the damper is enclosed within a housing, generally designated H. Housing H is mounted on a bifuricated bracket 18, by means of a plurality of screws or similar conventional fastening devices 20. Bracket 18 is, in turn, affixed to the section of flue F in which plate P is mounted, in any conventional manner.

Interposed between housing H and bracket 18, and mounted on screws 20, is a heat shield 22. Heat shield 22 is preferably a planar metal sheet having a first surface which faces, but is spaced from, housing H and a second surface which faces, but is spaced from, flue F. The purpose of heat shield 22 is to shield housing H, and the components situated therein, from the heat of the flue. Since the gases flowing through the flue are quite hot, and may be as hot as 1000° F., a substantial amount of heat is radiated by the flue to the surrounding environment. Heat shield 22 serves to protect housing H and the components therein, from the heat radiating from flue F. It should be noted that while only a single planar heat shielding member 22 is illustrated, as many similar planar heat shields as is required could be mounted, in spaced, parallel relationship, between housing H and bracket 18.

Shaft 10 extends through aligned openings in bracket 18, heat shield 22 and housing H into the interior of the housing. The rotational position of shaft 10 determines the rotational position of plate P within flue F. Thus, to rotate plate P from the fully open position to the fully closed position, it is required to rotate shaft 10 through an arc of 90°.

Situated within housing H are the components which control the rotational position of shaft 10 and, thus, the rotational position of plate P. The components are affixed to a substantially "U"-shaped mounting bracket 24. Mounted to the outside (left, as seen in FIGS. 1 and 2) of bracket 24 is the drive means, preferably in the form of a unidirectional electric motor, generally designated M. Motor M has a rotatable output shaft 26 which extends through bracket 24 to the interior (right, as seen in FIGS. 1 and 2) thereof. Shaft 26 is connected, through the interconnecting means 28 (described in detail below), to the end of shaft 10 such that the rotation of motor output shaft 26 serves to drive shaft 10 to position plate P. Motor output shaft 26 and plate positioning shaft 10 are substantially coaxially aligned.

Adjacent interconnecting means 28 are a pair of electrical switches $S_1$ and $S_2$ which control the energization and de-energization of motor M in accordance with the position of interconnecting means 28. Also situated on the outside of bracket 24, along with motor M, are a relay R, having a set of normally closed contacts, and a solid-state timer switch, generally designated T, the use of which is optional as described below.

Figure 8:
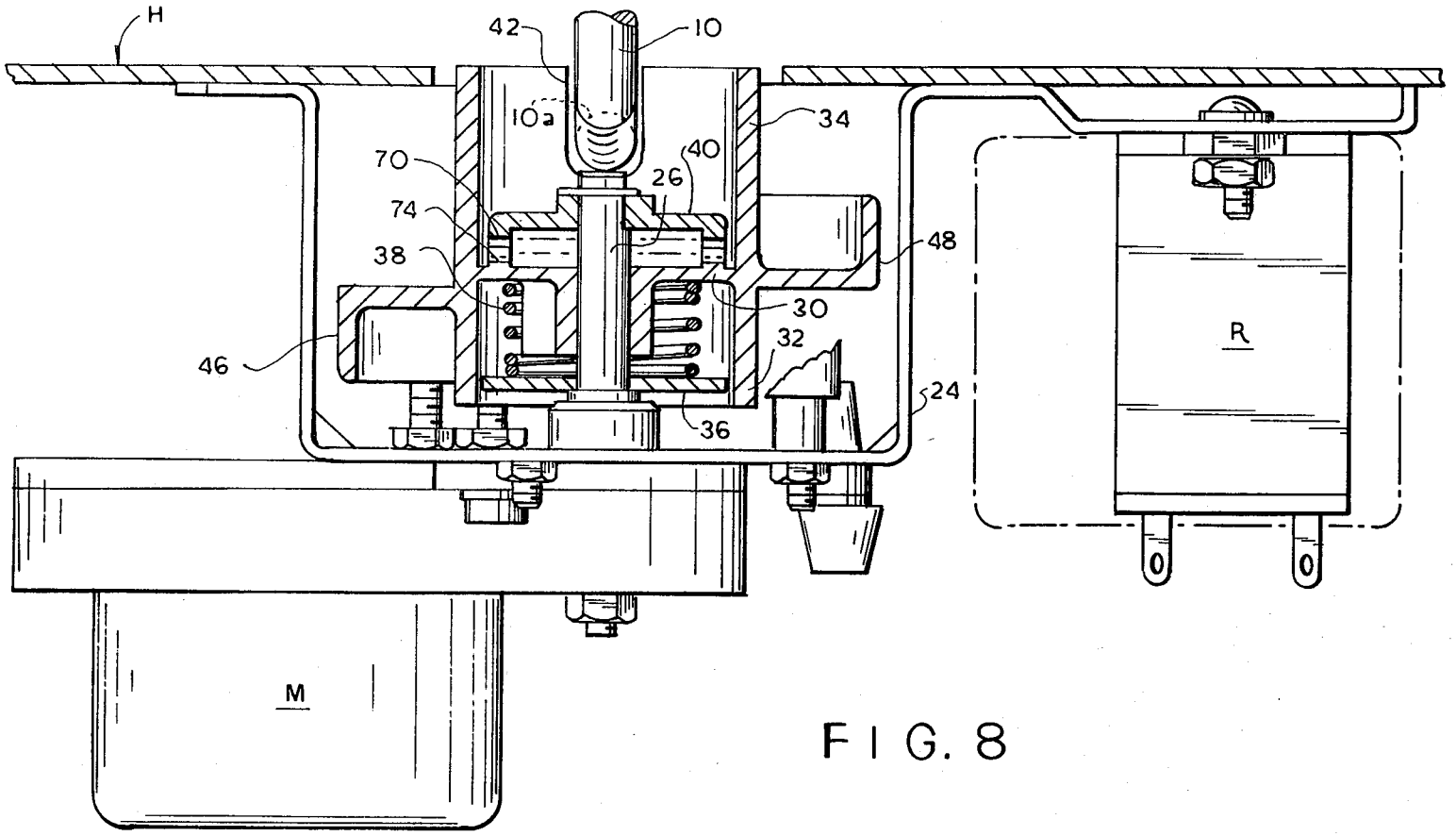
FIG. 8 is an enlarged cross-sectional view showing the clutch means and cams of the control mechanism of the present invention.
Figure 9:
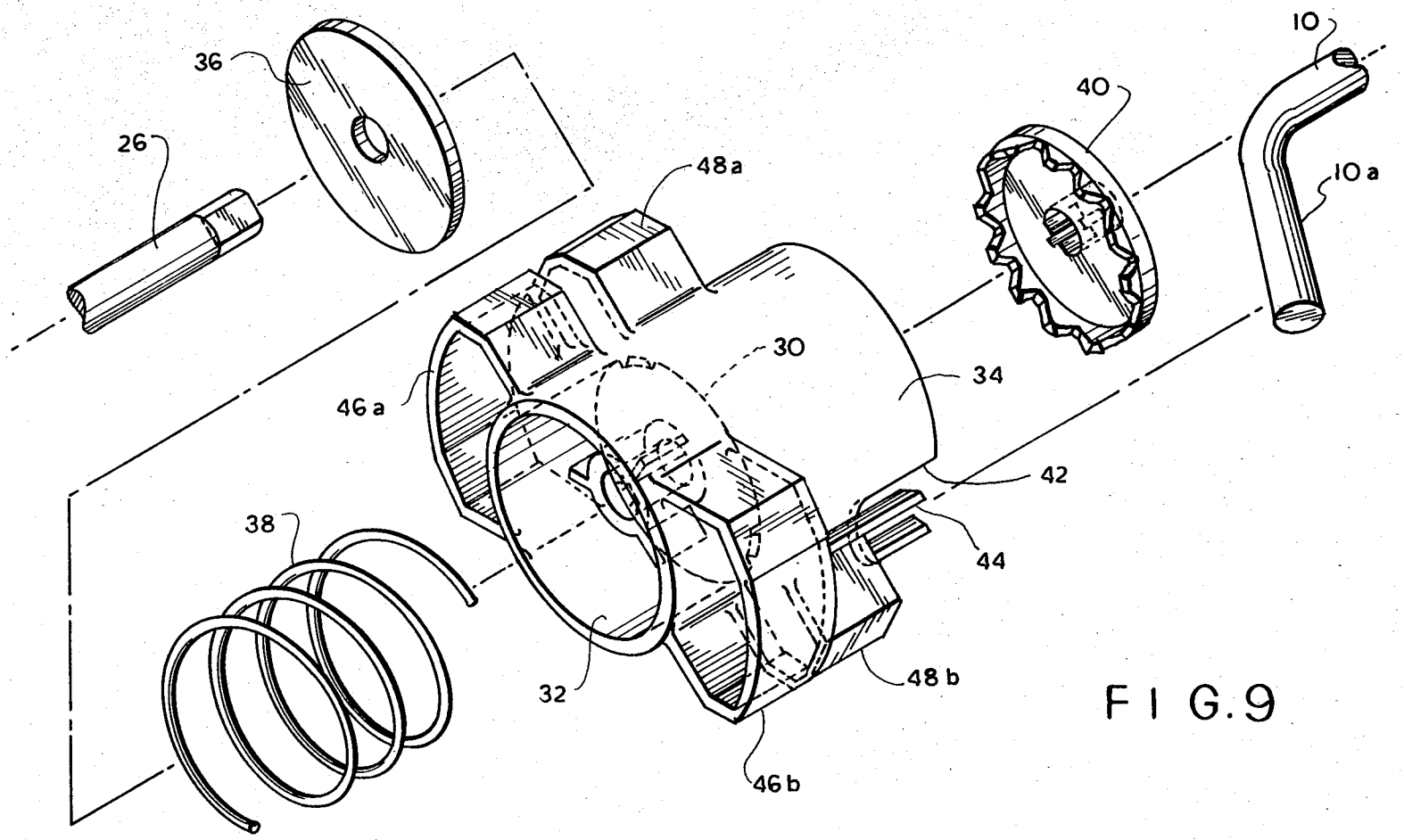
FIG. 9 is an exploded isometric view of the interconnecting means of the present invention.

FIGS. 8 and 9 illustrate the structure of interconnecting means 28 in detail. Interconnecting means 28 comprises a generally cylindrical body part, co-axially aligned with motor output shaft 26 and plate positioning shaft 10. A disc-like cam driver 30, situated within the body part, divides the body part into two hollow portions 32, 34. Shaft 26 from motor M extends through portion 32 of interconnecting means 28, passes through a central opening in cam driver 30, and extends into portion 34. Freely rotatably mounted on shaft 26 is a washer 36. In between washer 36 and the underside of cam driver 30 is situated a compression spring 38. The portion of shaft 26 which extends beyond cam driver 30 is keyed to a clutch driver 40, such that clutch driver 40 rotates with shaft 26. Clutch driver 40 has a substantially cup-shaped configuration with a plurality of protrusions and recesses formed on the rim thereof. The upper surface of cam driver part 30 has a plurality of protrusions spaced around the periphery thereof. Spring 38 normally serves to bias cam driver 30 towards clutch driver 40 such that same interengage.

Portion 34 of interconnecting means 28 is provided with a recess 42 in the wall thereof. Recess 42 is elongated in the direction of the axis of motor shaft 26 but laterally spaced therefrom. The width of recess 42 is somewhat larger than the diameter of plate positioning shaft 10. Plate positioning shaft 10 has a portion 10*a* which is bent away from the axis of rotation of the shaft. It is the bent portion 10*a* of shaft 10 which is received within recess 42.

A spring lever 44 extends from the surface of interconnecting means 28, in a direction generally parallel to the axis of shaft 26, to a position alongside recess 42. Spring lever 44 exerts a force on the bent portion 10*a* of shaft 10, when same is situated within recess 42, in a direction which is tangential to the axis of rotation of interconnecting means 28. Spring lever 44 tends to keep portion 10*a* of shaft 10 against the edge of the wall of interconnecting means 28 defining recess 42. However, bent portion 10*a* and interconnecting means 28 can be moved relative to each other, against the force of spring lever 44, a distance limited by the width of recess 42, under certain circumstances which are described in detail below.

The rotation of shaft 26 rotates clutch driver 40 which is keyed thereto. Spring 38 serves to bias cam driver 30 towards clutch driver 40, such that the teeth on each interengage, to cause interconnecting means 28 to rotate along with clutch driver 40. The rotation of interconnecting means 28 causes shaft 10 to rotate along with clutch driver 40. The rotation of interconnecting means 28 causes shaft 10 to rotate along with it, because the bent part 10*a* of shaft 10 is situated within recess 42. Under normal circumstances, rotation of the motor shaft 26 is transferred through interconnecting means 28 to plate positioning shaft 10, such that energization of the motor M causes plate P to change position.

However, should plate P be locked in position, interconnecting means 28 and thus cam driver 30 cannot rotate. Energization of the motor under these conditions will cause shaft 26 and clutch driver 40 to rotate and thus clutch driver 40 will "slip" relative to cam driver 30. Thus, interconnecting means 28 functions as a slip clutch.

Interconnecting means 28 also comprises cam means. Two sets of radially extending cam surfaces 46 and 48 are provided. Each set of cam surfaces comprises two, separate, oppositely oriented cam surfaces. Set 46 comprises cam surfaces 46*a* and 46*b*, which are identical in contour and situated around the circumference of interconnecting means 28 in diametrically opposed positions, such that they are 180° out of phase. Similarly, set 48 comprises two cam surfaces 48*a* and 48*b*, also identical in contour and also diametrically opposed around the circumference of interconnecting means 28 so as to be 180° out of phase. Sets 46 and 48 are situated in side-by-side relationship along the axis of interconnecting means 28, such that set 46 is aligned with the actuator of switch $S_1$, whereas set 48 is aligned with the actuator of switch $S_2$.

Figure 7:
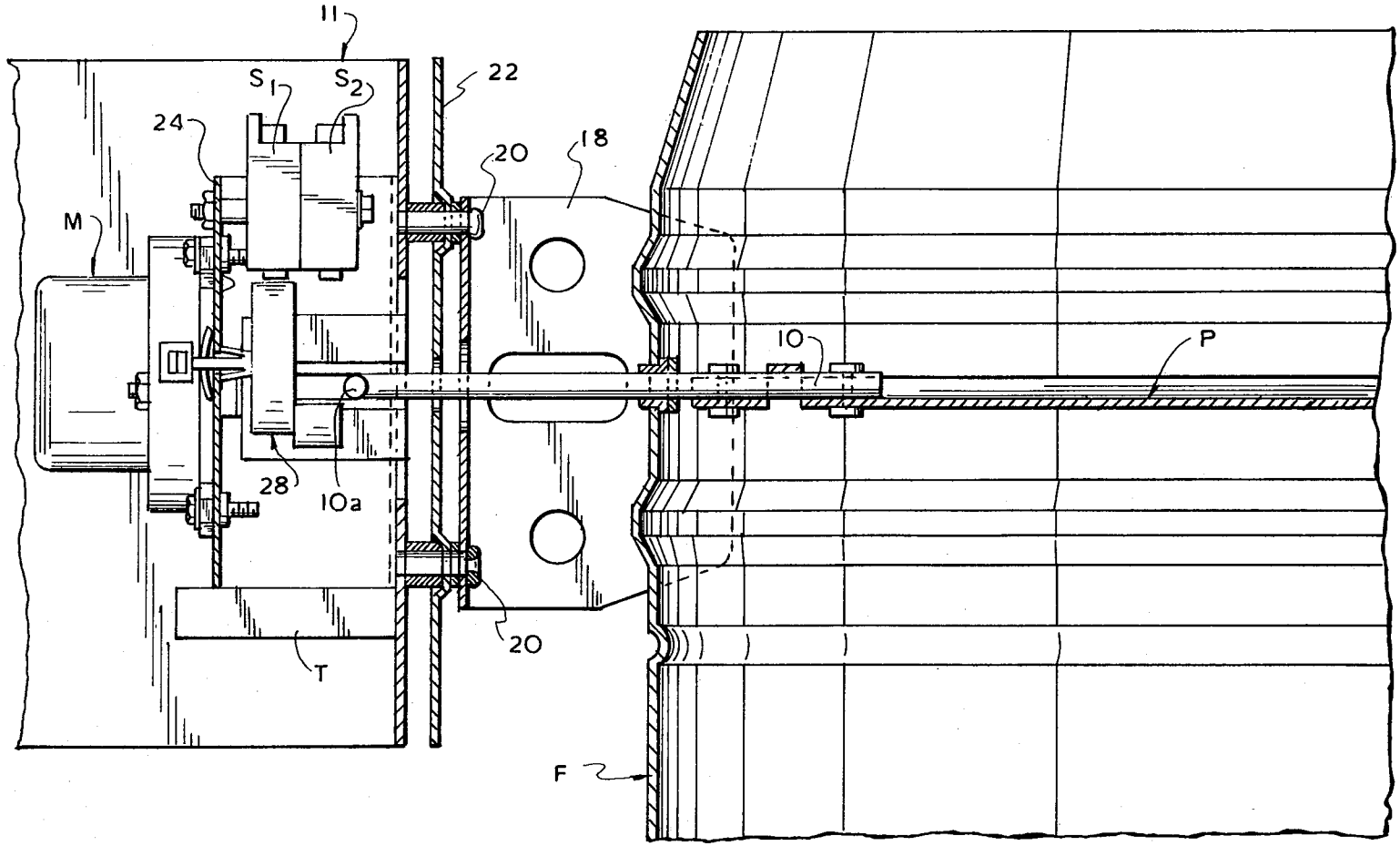
FIG. 7 is an enlarged cut away side view of the present invention showing the control mechanism in detail.

As can be seen in FIG. 7, switch $S_1$ and $S_2$ are situated in side-by-side relationship, in a direction parallel to the axis of rotation of interconnecting means 28. Thus, each cam set is aligned with the actuator of a different switch and controls the depression of the align actuator.

It is now evident that interconnecting means 28 has dual functions. It functions to drivingly interconnect motor output shaft 26 with plate positioning shaft 10, through a slip clutch mechanism. In addition, interconnecting means 28 carries cam sets 46 and 48 so as to control the actuation of switches $S_1$ and $S_2$ in accordance with the rotational position of interconnecting means 28 and, thus, plate P.

Figure 10:
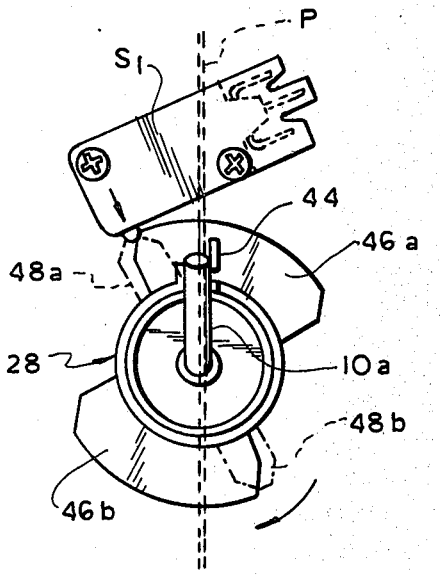
FIG. 10 is a view of the interconnecting means showing the position of the first cam and first switch, when the plate is in the fully open position.
Figure 11:
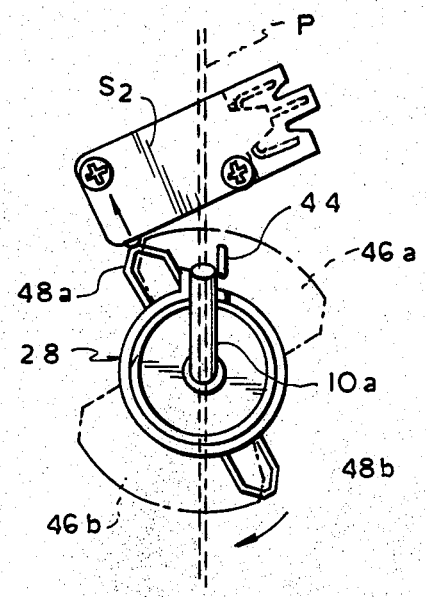
FIG. 11 is a view of the interconnecting means showing the position of the second cam and second switch, when the plate is in the fully open position.
Figure 12:
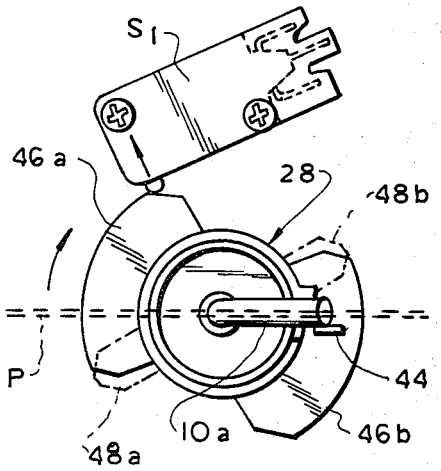
FIG. 12 is a view of the interconnecting means showing the position of the first cam and first switch, when the plate is in the fully closed position.
Figure 13:
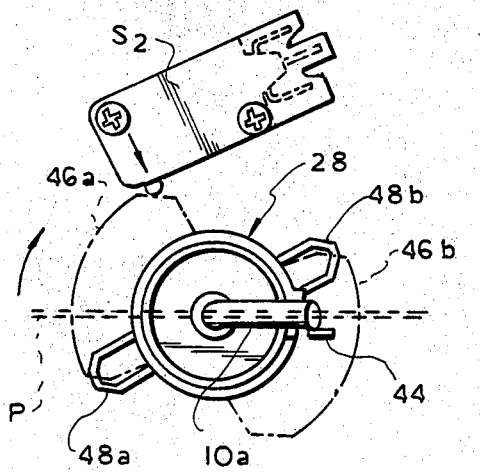
FIG. 13 is a view of the interconnecting means showing the position of the second cam and second switch when the plate is in the fully closed position.
Figure 14:
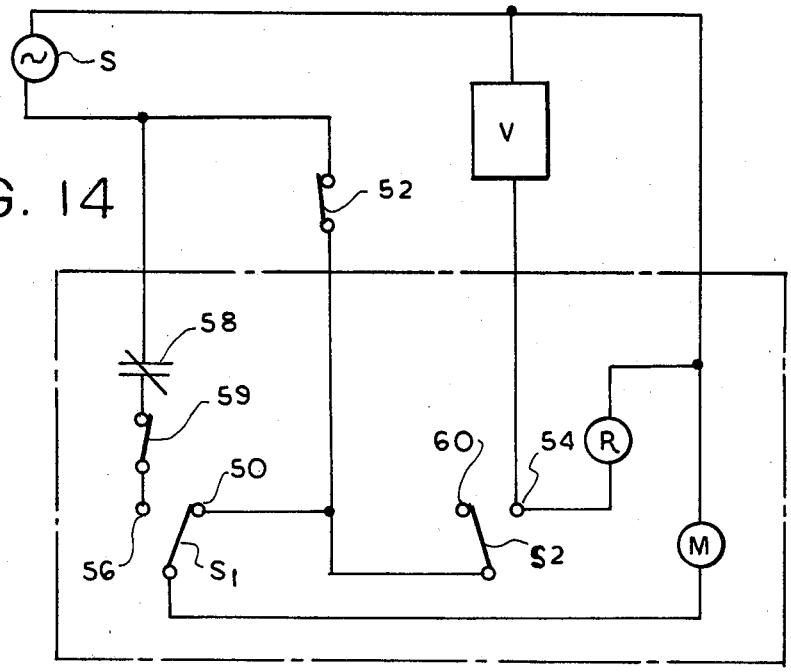
FIGS. 14, 15, 16 and 17 are schematic diagrams showing the control sequence for the present invention.

The normal operation of the vent damper can best be appreciated in conjunction with FIGS. 10–17. Assume that plate P is initially in the fully closed position causing interconnecting means 28 to be in the position shown in FIGS. 12 and 13. The actuator of switch $S_1$ is depressed by cam surface 46*a*, as shown in FIG. 12. The actuator of switch $S_2$ is not depressed by cam surface 48*a*, as shown in FIG. 13. The states of the switches $S_1$ and $S_2$ are as shown in schematic diagram FIG. 14.

Figure 15:
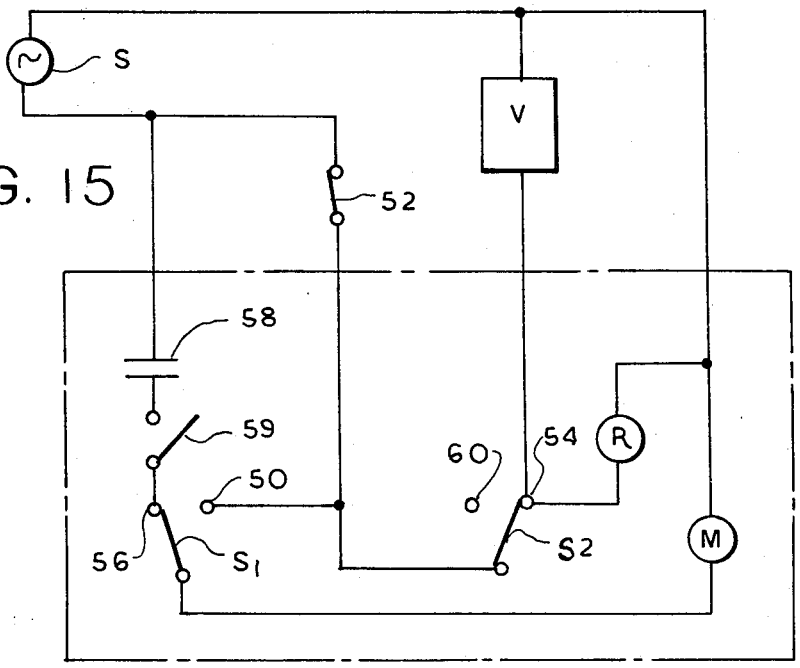

One pole 50 of switch $S_1$ is conditionally connected, through an external thermostat 52, to one side of an AC source S. When heat is demanded, that is, thermostat 52 senses a temperature below a preset level, thermostat 52 closes such that switch $S_1$ connects motor M to source S, energizing same. The energization of motor M causes the motor output shaft 26 to rotate interconnecting means 28 in a clockwise direction, viewing in the direction of line 6—6 in FIG. 2, such that plate P is moved from the fully closed towards the fully open position. After about 86° of rotation, cam 48*a* depresses the actuator of switch $S_2$, so as to cause switch $S_2$ to connect pole 54 to source S, through thermostat 52 (see FIG. 15). After about 4° more of rotation, that is, 90° of rotation from the initial fully closed position, the plate is in the fully open position, the actuator of switch $S_1$ is released by cam 46*a* and switch $S_1$ is connected to pole 56, as shown in FIG. 15. FIGS. 10 and 11 illustrate the position of the cams with respect to switches $S_1$ and $S_2$, respectively, when the plate is in the fully open position.

Connecting pole 54 to source S, through thermostat 52, energizes the gas valve V of the gas fired furnace (or the burner motor and valve of an oil fired furnace) and, at the same time, relay R, connected in parallel with valve V, is energized, such that normally closed relay contacts 58, situated between source S and pole 56 of switch $S_1$, open. The opening of relay contacts 58 prevents the motor M from being energized to close the plate when the furnace is operational.

Once the furnace is operational, the stack begins to heat up. As this occurs, a flue temperature sensitive switch 59, situated between contacts 58 and pole 56 of switch $S_1$, opens as illustrated in FIG. 15. Switch 59 will prevent motor M from being energized to close the plate while the stack temperature exceeds a given level.

Figure 16:
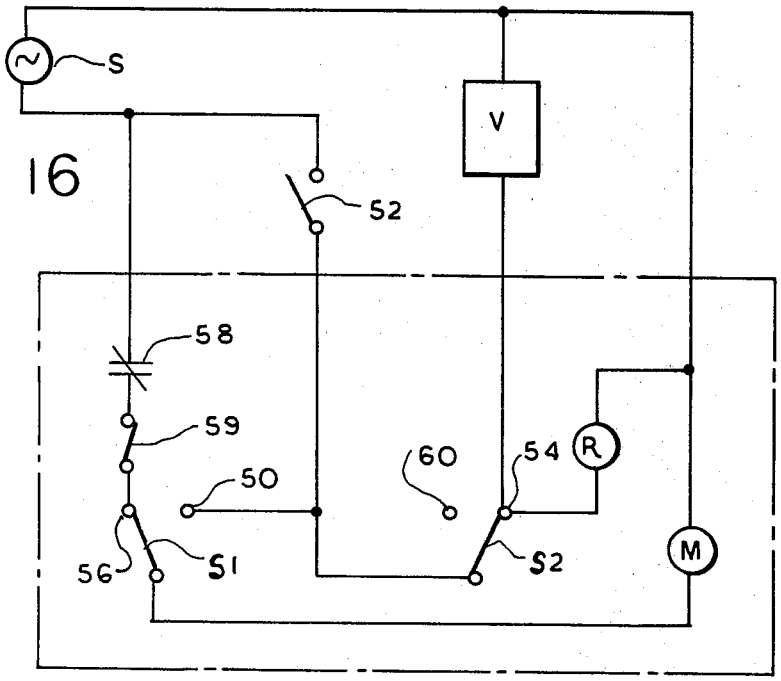

Once the heat demand has been satisfied, thermostat 52 opens. This disconnects source S from valve V to immediately stop the furnace and, in addition, disconnects source S from relay R, such that contacts 58 close (FIG. 16). After the stack cools, switch 59 closes, connecting pole 56 of switch $S_1$ to source S through closed contacts 58. This causes motor M to be energized by source S, such that the output shaft thereof begins to rotate plate P from the fully open position towards the fully closed position.

Figure 17:
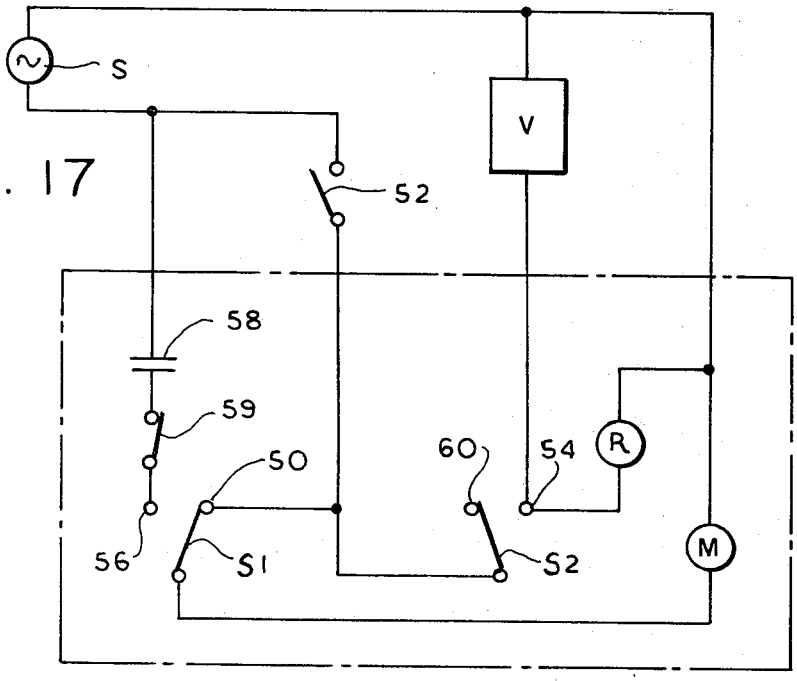

After about $8\frac{1}{2}$° of rotation, cam 48*a* releases the actuator of switch $S_2$, such that switch $S_2$ moves to pole 60, as illustrated in FIG. 17. After an additional $81\frac{1}{2}$° rotation, that is, 90° from the fully closed position, the plate is in the fully open position and switch $S_1$ switches back to pole 50. In this position, interconnecting means 28 again appears as is seen in FIGS. 12 and 13 and the switches are in the condition shown in FIG. 17. In this condition, when heat is again demanded, thermostat 52 will close and the cycle will begin again.

The above-described embodiment can be modified slightly for use with an oil fired furnace. In this case, the flue temperature sensing switch is replaced by optional timer T and pole 60 of switch $S_2$ is connected to motor M, such that motor M can be energized through either switch $S_1$ or switch $S_2$ when the latter is connected to pole 60. The operation of the mechanism is, however, essentially the same, except that timer T closes approximately three minutes after contacts 58 of relay R close, thus permitting the stack to cool sufficiently.

Figure 4A:
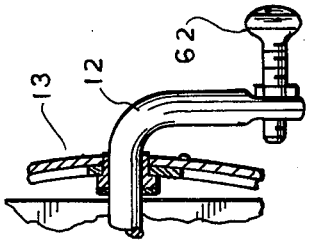
FIG. 4A is a top view of the manual override lever of the present invention.
Figure 4B:
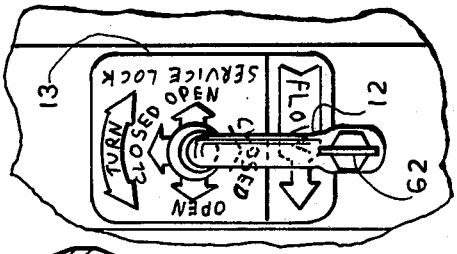
FIG. 4B is a front view of the flue surface showing manual override lever of the present invention.

As mentioned above, the device of the present invention is provided with a shaft 12 which is accessible from the exterior of flue F. The exterior portion of shaft 12 is shown in detail in FIGS. 4A and 4B. The end of shaft 12 is bent from the axis of rotation thereof. A locking screw 62, with external screw threads, is received within an internally threaded opening at the end of the bent portion of shaft 12. A recess 63, as shown in FIG. 1, is provided on the exterior surface of the flue F such that when shaft 12 is in the position where plate P is fully open, screw 62 may be rotated until the end thereof is received in the recess. In this manner, plate P is locked in the fully open position. As illustrated in FIG. 4B, the exterior surface of flue F is provided with a plate 13 indicating the proper position. Thus, means are provided for locking the plate in the fully open position.

In the event of a malfunction of the unit, for example, a failure of a plate shaft bearing or a misaligning of the plate relative to the flue, if heat were demanded by the closing of thermostat 52, the motor would be unable to react to move the plate to the fully open position. Thus valve V can not be energized because $S_2$ can not move to connect valve V with source S. This is for safety reasons as the actuation of the furnace, while the flue was closed, would cause a build-up of noxious gas by-products of combustion which could be lethal. Normally, emergency repair service would be required because failure of the unit would prevent actuation of the furnace. However, in the present invention, it is possible to use the emergency manual override, which takes the form of lever 12, to manually cause the plate to move to the fully open position, moving switch $S_2$ to pole 54, such that the furnace can operate normally.

However, as can be appreciated from FIG. 10, in the fully open position, cam surface **46*a* does not depress the actuator of switch $S_1$, such that switch $S_1$ is connected to the pole 56. Thus, when heat demand is satisfied and thermostat 52 switches off, the furnace will stop operating and relay contacts 58 will close. After the switch 59 closes, motor M will be energized. The energization of motor M would normally cause the plate to move from the fully open to the fully closed position, at which time the motor would be de-energized. However, if the plate is locked in the fully open position, it obviously cannot be moved to the fully closed position to de-energize the motor and, thus, the motor would thereafter run continuously. This is disadvantageous because it creates a great deal of noise and could result in the eventual burning out of the motor. This problem is overcome in a manner which is illustrated in FIGS. 18–21**.

When the motor is energized, such that motor output shaft 26 and clutch driver 40 keyed thereto rotate, but plate P is locked in the fully open position, such that bent portion **10*a* of shaft 10 prevents the interconnecting means 28 from moving in the normal direction, slippage of clutch driver 40 with respect to cam driver 30 will occur. This causes interconnecting means 28 to move in a direction opposite to its normal direction of rotation, against the action of spring lever 44, through a very limited arc defined by the wall of recess 46, into which bent portion 10*a* of shaft 10 is received. This relatively small rotation in the direction opposite to normal is sufficient to cause cam 46*a* to depress the actuator of switch $S_1$, so as to move switch $S_1$ to pole 50** and, thereby, de-energize motor M. Thus, motor M is automatically de-energized a brief period after the energization thereof.

FIG. 18 discloses the relative position of the interconnecting means 28 and switch $S_1$ when the plate P is in the fully open position. FIG. 20 shows the relative position of the parts of the clutch mechanism and, in particular, the surface of clutch driver 40 and the surface of cam driver 30, which are biased together through the compression spring 38, as depicted by the vertical arrow, to normally interengage. The surface of clutch driver 40 comprises a recess 70, bounded on one side by a protrusion having a corner 72. The surface of clutch driver 30 has a protrusion 74, with an inclined surface 76.

Parts 30 and 40 are normally in the relative position shown in FIG. 20. Specifically, protrusion 74 (see FIG. 8) of cam driver 30 is received within recess 70 (see FIG. 8) of clutch driver 40 and is maintained therein by the biasing of the spring. The number of recesses in clutch driver 40 must be an integral multiple of the number of protrusions 74 in cam driver 30, or vice versa. As long as plate P and, thus, cam driver 30, is free to rotate, parts 30 and 40 will remain in this relative position whether the motor is energized or not.

However, if plate P is locked in the fully open position, cam driver 30 will be unable to rotate along with clutch driver 40. Thus, when the heat demand has been satisfied and the furnace is deactuated, motor M will be energized, because the actuator of switch $S_1$ is not depressed, as shown in FIG. 18.

When the motor is energized, clutch driver 40 begins to rotate in the direction of the horizontal arrows, shown in FIGS. 20 and 21. However, cam driver 30 cannot rotate along with clutch driver 40 and, thus, clutch driver 40 moves relative to cam driver 30 to a second relative position, against the biasing of spring 38. The second relative position is shown in FIG. 21. Protrusion 74 is no longer seated within recess 70, but the corner 72 abuts the inclined surface 76.

At this point, the urging of biasing spring 38 causes parts 30 and 40 to once again move toward each other such that inclined surface 76 slides along the corner 72 until protrusion 74 is in the next recess, partially defined by the corner 72 and, thus, the parts attain a third relative position, as shown in FIG. 22. For this to occur, cam driver 30 must move in a direction opposite to its normal direction, as indicated by the horizontal arrow in FIG. 22. This is possible because recess 44 in the upper portion 34 of interconnecting means 28, into which bent portion **10*a* of plate positioning shaft 10** is received, is somewhat wider than the diameter of the shaft.

As shown in FIG. 18, the shaft is normally biased against one wall (left, as seen in FIG. 18) of the recess by spring lever 46. The greater width of recess 46, as compared to the diameter of shaft 10, permits movement of interconnecting means, in a direction opposite to its direction of normal rotation, against the action of spring lever 46, to a limited degree, as shown in FIG. 19. This limited backward movement is sufficient to cause cam **46*a*** to depress the actuator of switch $S_1$, thereby de-energizing the motor.

In other words, if the plate is locked in the fully open position, once conditions are appropriate for energizing the motor to close the plate, the motor is energized such that parts 30 and 40 move from a first relative position, which is the normal interengaging drive position, to a second relative position, in a first direction. The biasing of the spring 38, urging parts 30 and 40 towards each other, then causes the part 30 to move to a third relative position, in a direction opposite to the direction of movement between the first relative position and the second relative position. Movement in the opposite direction, from the second relative position to the third relative position, is against the urging of the resilient connecting means, in the form of spring lever 46, and is possible because recess 44 is somewhat larger than the diameter of shaft 10. Once at the third relative position, cam 46*a* on the interconnecting means 28 is located in a position to depress the actuator of switch $S_1$, thereby automatically terminating the energization of the motor a very short time after the motor has been energized. During these relative motions between parts 30 and 40, the switch $S_2$ is maintained with its contact on the pole 54.

It should now be appreciated that the present invention relates to a vent damper which includes an emergency manual override which may be employed to keep the furnace operating safely in the event of a malfunction of the damper unit. This result is achieved without the motor running continuously in the emergency condition. Specifically, if the plate is locked in the open position and conditions are such that the motor is energized to move the plate to the closed position, energization of the motor is automatically terminated, a very short period after the motor is energized, through the use of a slip clutch and a mechanism which is sensitive to the slipping of the clutch in order to terminate the energization of the motor. This is accomplished in part by resiliently connecting the plate positioning shaft to the clutch, in a manner which permits rotation of one of the clutch parts, against the resilient connection, to a degree sufficient to change the condition of the switch and terminate the energization of the motor.

In addition, the interconnection between the plate positioning shaft and the clutch permits limited lateral movement between the plate positioning shaft and the clutch, such that misalignment between the axis of the plate positioning shaft and the axis of the clutch and, thus, the motor output shaft, will not cause wearing of the bearings on either shaft.

Further, the control mechanism for the plate is located in a housing which is shielded from the heat of the flue. In this manner, the parts within the housing are protected from overheating and the life thereof is extended.

While only a single preferred embodiment of the present invention has been disclosed herein for purposes of illustration, it is obvious that many modifications and variations could be made thereto. It is intended to cover all of these modifications and variations which fall within the scope of the present invention, as defined by the following claims:

I claim:

1. A device for controlling the flow of fluid through a conduit comprising drive means, a movable damper plate situated in the conduit, clutch means for drivingly interconnecting said plate and said drive means, means for controlling said drive means in response to the position of said plate, and means for locking said plate in a given position, said clutch means comprising a slip clutch adapted to slip when said locking means is actuated to prevent movement of said plate from said given position.

2. The device of claim 1 wherein said control means is effective, when said plate is in a given position, to energize said drive means, said energization of said drive means normally resulting in movement of said plate from said given position, and further comprising means for de-energizing said drive means when said locking means is actuated to prevent said plate from moving from said given position.

3. The device of claim 2, wherein said clutch means comprises a slip clutch adapted to slip, during energization of said drive means, if said locking means is actuated and means responsive to the slipping of said clutch means for terminating the energization of said drive means.

4. The device of claim 3, wherein said slip clutch means comprises said interconnecting means.

5. The device of claim 4, further comprising means for resiliently connecting said plate with said interconnecting means.

6. The device of claim 2, for use in conjunction with a power source and temperature sensitive switch means for connecting said control means to said source to energize same, when a temperature below a given level is sensed, wherein said control means is effective to energize said drive means to move said plate to said given position, when said control means is connected to said source and said plate is not in said given position.

7. The device of claim 6, for use with an appliance having a flue in which said plate is situated, wherein said control means further comprises flue temperature sensitive switch means, operably connected to said source, and first and second switches, said first switch being switchable between a first position, wherein said drive means is conditionally connected to said source through said flue temperature sensitive switch means, and a second postion, wherein said drive means is conditionally connected to said source through said temperature sensitive switch means and said second switch being switchable between a first position wherein said appliance is conditionally connected to said source and a second position wherein said appliance is disconnected from said source.

8. The device of claim 7, wherein said control means further comprises a relay operably connected to be energized with said appliance and having normally closed contacts operably connected between said source and said first position of said first switch.

9. The device of claim 1, further comprising a support and wherein said plate, drive means, and interconnecting means are mounted on said support and further comprising heat shield means, physically interposed between said support and the conduit, to shield said support and the components thereon from the heat of said conduit.

10. The device of claim 9, wherein said heat shield means comprises a planar member having first and second surfaces facing said support and the conduit, respectively.

11. The device of claim 10, wherein said member has an opening therein through which said plate positioning means extends.

12. The device of claim 9, wherein said heat shield means comprises a plurality of substantially parallelly situated planar members.

13. The device of claim 1, wherein said clutch means comprises first and second parts, said parts being operably connected for movement with said drive means and said plate, respectively, each of said parts having engaging means thereon and means normally biasing said engaging means to interengage.

14. The device of claim 13, wherein said engaging means are effective to engage said parts in a first relative position, wherein said biasing means cooperates with said engaging means to prevent relative movement between said parts and in a second relative position, wherein said biasing means cooperates with said engaging means to cause relative movement between said parts from said second relative to a third relative position.

15. The device of claim 14, further comprising resilient means for biasing said parts against movement from said second relative position to said third relative position.

16. The device of claim 14, wherein relative movement between said parts, from said second to said third relative position, is in a direction opposite to the direction of movement from said first to said second relative position.

17. The device of claim 14, wherein said slipping responsive means is responsive to movement of said parts from said second to said third relative positions.

18. The device of claim 13, wherein said engaging means on said first part comprises recesses and said engaging means on said second part comprises a protrusion adapted to be at least partially received in said recess.

19. The device of claim 18, wherein said engaging means on said second part further comprises an inclined surface.

20. The device of claim 19, wherein said inclined surface on said second part forms a portion of said protrusion.

21. The device of claim 20, wherein said recess is defined, in part, by a second protrusion on said first part.

22. The device of claim 1 wherein said drive means comprises a rotatable output member, said plate comprises a rotatable input member, and further comprising means for drivingly interconnecting said output member and said input member for simultaneous rotation, said interconnecting means comprising means for permitting limited lateral movement between said output member and said input member, as said members rotate.

23. The device of claim 22, wherein said movement permitting means comprises a part extending in a direction substantially parallel to the axis of rotation of said output member, but laterally spaced therefrom and having a recess therein and further comprising a section of said input member bent from the axis of rotation thereof, said input member section being freely received in said recess.

24. The device of claim 23, wherein said part is substantially cylindrical and coaxially aligned with said output member.

25. The device of claim 23, wherein said recess is elongated in a direction substantially parallel to said axis of rotation of said output member.

26. The device of claim 23, further comprising resilient means active on said section of said input member for positioning same relative to said recess.

27. The device of claim 26, wherein said resilient means is active on input member section in a direction which is tangential to the axis of rotation of said input member.

28. The device of claim 26, wherein said resilient means comprises a spring lever extending in a direction substantially parallel to the axis of rotation of said output member.

29. The device of claim 28, wherein said lever is laterally spaced from said axis of rotation of said output member.

30. The device of claim 1 further comprising a support, said drive means being mounted on said support, output means connected to be driven by said drive means, means for positioning said plate relative to the conduit, means located on said support for operably drivingly interconnecting said output means and said positioning means, means on said support for controlling said drive means, and heat shield means, physically interposed between said support and the conduit to shield said support and the components located therein from the heat of the conduit.

31. The device of claim 1, further comprising means for energizing said drive means, said energizing means comprises switch means having actuator means, and wherein the position of said actuator means is controlled by said interconnecting means.

32. The device of claim 31, wherein said drive means has a rotatable output member and wherein said damper plate has a rotatable input member, said interconnecting means interconnecting said output member and said input member for substantially simultaneous rotation, and wherein said interconnecting means further comprises cam means, said cam means being moved, relative to said actuator means, by said output member.

* * * * *